US010138884B2

(12) United States Patent
Stachowiak, Jr.

(10) Patent No.: US 10,138,884 B2
(45) Date of Patent: Nov. 27, 2018

(54) NICKEL CORROSION BARRIER UNDER CHROME FOR SUCKER ROD PUMPS

(71) Applicant: Weatherford Technology Holdings, LLC, Houston, TX (US)

(72) Inventor: John Edward Stachowiak, Jr., Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 201 days.

(21) Appl. No.: 14/972,675

(22) Filed: Dec. 17, 2015

(65) Prior Publication Data

US 2016/0177944 A1 Jun. 23, 2016

Related U.S. Application Data

(60) Provisional application No. 62/095,112, filed on Dec. 22, 2014.

(51) Int. Cl.

| | |
|---|---|
| ***F04B 53/14*** | (2006.01) |
| ***C25D 5/14*** | (2006.01) |
| ***C25D 5/50*** | (2006.01) |
| ***C25D 7/00*** | (2006.01) |
| ***F04B 47/02*** | (2006.01) |

(Continued)

(52) U.S. Cl.

CPC ..... *F04B 53/14* (2013.01); *C23C 18/1651* (2013.01); *C23C 18/1653* (2013.01); *C23C 18/1692* (2013.01); *C25D 5/14* (2013.01); *C25D 5/50* (2013.01); *C25D 7/00* (2013.01); *F04B 47/02* (2013.01); *C23C 18/1605* (2013.01); *C25D 5/022* (2013.01)

(58) Field of Classification Search

CPC ..... F04B 53/14; C25D 5/14

See application file for complete search history.

(56) References Cited

U.S. PATENT DOCUMENTS 3,759,802 A * 9/1973 Castelet ..... C25D 3/12 205/113

2014/0178637 A1* 6/2014 Rajagopalan ..... C23C 28/044 428/141

FOREIGN PATENT DOCUMENTS

CA 2905513 A1 9/2014

CA 2905548 A1 9/2014

(Continued)

OTHER PUBLICATIONS

Canadian Office Action dated Apr. 5, 2017, for Canadian Patent Application No. 2,916,161.

*Primary Examiner* — Thomas E Lazo

(74) *Attorney, Agent, or Firm* — Patterson + Sheridan, LLP

(57) ABSTRACT

In one embodiment, a rod pump comprises a barrel and a plunger disposed within the barrel. The plunger comprising a nickel layer disposed thereon, and a chrome layer disposed on the nickel layer. In another embodiment, a rod pump comprises a barrel, and a plunger disposed with the barrel. The barrel comprises a nickel layer disposed thereon, and a chrome layer disposed on the nickel layer. In yet another embodiment, a rod pump comprises a barrel and a plunger disposed within the barrel, wherein each of the barrel and plunger has a nickel layer and a chrome layer disposed thereon. In yet another embodiment, a method of processing a rod pump comprises depositing a nickel layer on a barrel or a plunger of the rod pump, and depositing a chrome layer on the nickel layer.

20 Claims, 3 Drawing Sheets

(51) Int. Cl.
*C25D 5/02* (2006.01)
*C23C 18/16* (2006.01)

(56) References Cited

FOREIGN PATENT DOCUMENTS

| | | | | |
|---|---|---|---|---|
| CN | 1097816 | A | * | 1/1995 |
| CN | 203035643 | U | * | 7/2013 |

* cited by examiner

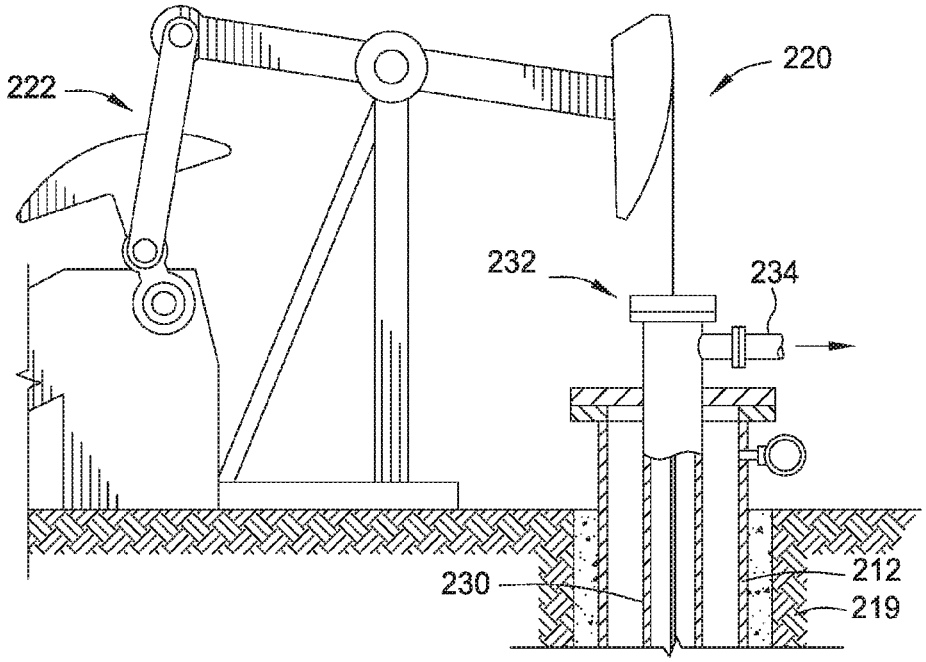
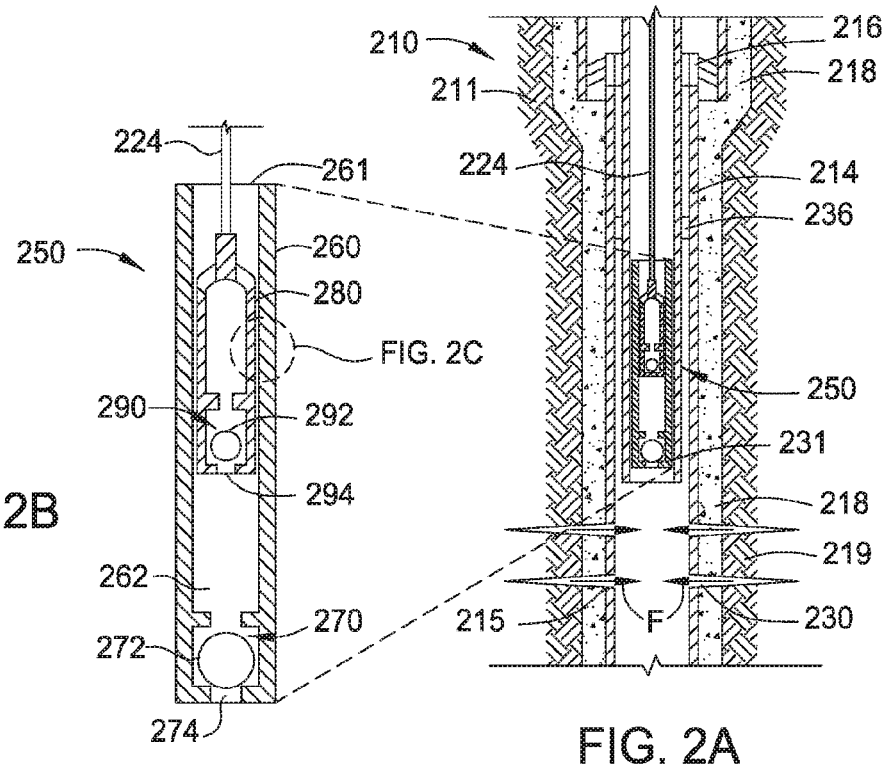
FIG. 2A
FIG. 2B

NICKEL CORROSION BARRIER UNDER CHROME FOR SUCKER ROD PUMPS

CROSS-REFERENCE TO RELATED APPLICATIONS

This application claims benefit of U.S. Provisional Patent Application Ser. No. 62/095,112, filed Dec. 22, 2014, which is herein incorporated by reference.

BACKGROUND

Field

Embodiments of the present disclosure generally relate to sucker rod pumps, and more specifically, to coatings for sucker rod pump plungers and barrels.

Description of the Related Art

Beam pumping, or the sucker-rod lift method, is the oldest and most widely used type of artificial lift for most wells. A sucker-rod pumping system is made up of several components, including a surface-pumping unit and an underground pump, e.g., a rod pump, coupled to one another by a sucker rod. The inside surface finish and inside diameter of the sucker rod pump barrel affect the operation of the rod pump due to the small clearances that exist between the pump barrel and the plunger (e.g., about 0.002 inches per side). If the clearances are too large, efficiency of the pump is reduced. In addition to large clearances, scoring from sand or other particulate can also cause the efficiency of the sucker rod pump to drop. Scoring can be exacerbated in instances of reduced clearance.

To reduce scoring of the rod pump, conventional approaches have utilized a chrome coating on components of the rod pump. Chrome, however, is subject to "microcracking" which renders the chrome porous. FIG. 1 illustrates a conventional chrome coating 190 disposed on a rod pump component 191. The chrome coating has a microcrack 192 formed therein. Within corrosive wells, fluid can penetrate the microcrack 192 of the chrome 190, resulting in corrosion 193 of the underlying steel substrate, such as a rod pump component 160. Corrosion of the underlying steel substrate significantly decreases the useful life of the rod pump.

As an alternative to steel, brass substrates have been proposed. However, the chrome layer is more susceptible to surface deformation when placed over a softer brass substrate.

Therefore, there is a need for a rod pump with reduced corrosion and scoring characteristics.

SUMMARY

In one embodiment, a rod pump comprises a barrel and a plunger disposed within the barrel. The plunger comprising a nickel layer disposed thereon, and a chrome layer disposed on the nickel layer. In another embodiment, a rod pump comprises a barrel, and a plunger disposed with the barrel. The barrel comprises a nickel layer disposed thereon, and a chrome layer disposed on the nickel layer. In yet another embodiment, a rod pump comprises a barrel and a plunger disposed within the barrel, wherein each of the barrel and plunger have a nickel layer and a chrome layer disposed thereon. In yet another embodiment, a method of processing a rod pump comprises depositing a nickel layer on a barrel or a plunger of the rod pump, and depositing a chrome layer on the nickel layer.

In one embodiment, a rod pump comprises a barrel; and a plunger disposed within the barrel, the plunger comprising a nickel layer disposed thereon, and a chrome layer disposed on the nickel layer.

In another embodiment, a rod pump comprises a barrel; and a plunger disposed within the barrel; wherein the barrel comprising a nickel layer disposed thereon, and a chrome layer disposed on the nickel layer.

In another embodiment, a method of processing a rod pump comprises depositing a nickel layer on a barrel or a plunger of the rod pump; and depositing a chrome layer on the nickel layer.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, and the disclosure may admit to other equally effective embodiments.

FIG. 2A is a sectional view of a reciprocating rod lift system having a rod pump according to one embodiment of the disclosure.

FIG. 2B is enlarged partial view of the reciprocating rod lift system of FIG. 2A.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

In one embodiment, a rod pump comprises a barrel and a plunger disposed within the barrel. The plunger comprising a nickel layer disposed thereon, and a chrome layer disposed on the nickel layer. In another embodiment, a rod pump comprises a barrel, and a plunger disposed with the barrel. The barrel comprises a nickel layer disposed thereon, and a chrome layer disposed on the nickel layer. In yet another embodiment, a rod pump comprises a barrel and a plunger disposed within the barrel, wherein each of the barrel and plunger have a nickel layer and a chrome layer disposed thereon. In yet another embodiment, a method of processing a rod pump comprises depositing a nickel layer on a barrel or a plunger of the rod pump, and depositing a chrome layer on the nickel layer.

Figure 1:
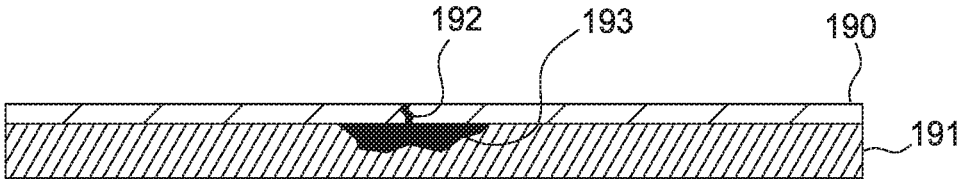
FIG. 1 (PRIOR ART)
FIG. 1 illustrates a conventional chrome coating on a rod pump.
Figure 2C:
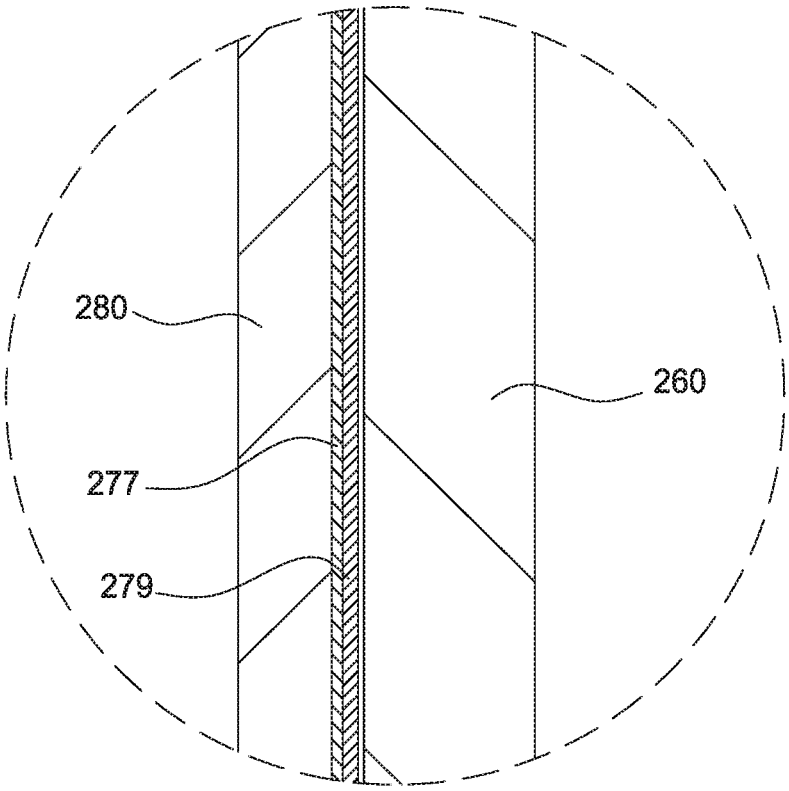
FIG. 2C illustrates an enlarged partial view of the rod pump 250.

FIG. 2A is a sectional view of a reciprocating rod lift system 220 having a rod pump according to one embodiment of the disclosure. FIG. 2B is enlarged partial view of the reciprocating rod lift system of FIG. 2A. FIG. 2C illustrates an enlarged partial view of the rod pump 250 shown in FIG. 2B.

The reciprocating rod lift system 220 may be used to produce production fluid from a wellbore. Surface casing 212 hangs from the surface and has a liner casing 214 hung therefrom by a liner hanger 216. Production fluid F from the formation 219 outside the cement 218 can enter the liner 214 through perforations 215. To convey the fluid F, production tubing 230 extends from a wellhead 232 downhole, and a packer 236 seals the annulus between the production tubing 230 and the liner 214. At the surface, the wellhead 232 receives production fluid and diverts it to a flow line 234.

The production fluid F may not naturally reach the surface so operators use the reciprocating rod lift system 220 to lift the fluid F. The system 220 has a surface pumping unit 222, a rod string 224, and a downhole rod pump 250. The surface pumping unit 222 reciprocates the rod string 224, and the reciprocating string 224 operates the downhole rod pump 250. The rod pump 250 has internal components attached to the rod string 224 and has external components positioned in a pump-seating nipple 231 near the producing zone and the perforations 215.

As shown in FIG. 2B, the rod pump 250 has a barrel 260 with a plunger 280 movably disposed therein. The barrel 260 has a standing valve 270, and the plunger 280 is attached to the rod string 224 and has a traveling valve 290. For example, the traveling valve 290 is a check valve (i.e., one-way valve) having a ball 292 and seat 294. The standing valve 270 disposed in the barrel 260 is also a check valve having a ball 272 and seat 274.

As the surface pumping unit 222 in FIG. 2A reciprocates, the rod string 224 reciprocates in the production tubing 230 and moves the plunger 280. The plunger 280 moves the traveling valve 290 in reciprocating upstrokes and downstroke. During an upstroke, the traveling valve 290 as shown in FIG. 2B is closed (i.e., the upper ball 292 seats on upper seat 294). Movement of the closed traveling valve 290 upward reduces the static pressure within the pump chamber 262 (the volume between the standing valve 270 and the traveling valve 290 that serves as a path of fluid transfer during the pumping operation). This, in turn, causes the standing valve 270 to unseat so that the lower ball 272 lifts off the lower seat 274. Production fluid F is then drawn upward into the chamber 262.

On the following downstroke, the standing valve 270 closes as the standing ball 272 seats upon the lower seat 274. At the same time, the traveling valve 290 opens so fluids previously residing in the chamber 262 can pass through the valve 290 and into the plunger 280. Ultimately, the produced fluid F is delivered by positive displacement of the plunger 280, out passages 261 in the barrel 260. The moved fluid F then moves up the wellbore 210 through the tubing 230 as shown in FIG. 2A. The upstroke and down stroke cycles are repeated, causing fluids to be lifted upward through the wellbore 210 and ultimately to the earth's surface.

FIG. 2C illustrates an enlarged partial view of the rod pump 250. As shown in FIG. 2C, an outer surface of the plunger 280 may be coated with nickel layer 277. A chrome layer 279 may be disposed on a radially-outward surface of the nickel layer 277. During operation of the rod pump 250, the chrome layer 279 reduces or resists abrasion due to particulates present within the rod pump 250. However, as discussed above, the chrome layer 279 may be susceptible to microcracks. In the event the chrome layer 279 develops one or more microcracks, the nickel layer 277 prohibits the penetration of corrosive fluids to an underlying steel substrate, such as the plunger 280, thereby preventing corrosion of the underlying substrate and maintaining the useful life of the substrate.

Moreover, because the nickel layer prevents corrosion of the underlying steel substrate, this increased substrate hardness reduces the likelihood of point-load deformation (e.g. a single hard sand particle that may "push" the chrome layer into the substrate) of the hard chrome layer as compared to chrome plated brass. While FIG. 2C illustrates the nickel layer 277 and the chrome layer 279 disposed on the radially-outward surface of the plunger 280, it is contemplated that a nickel layer 277 and a chrome layer 279 may additionally or alternatively be disposed on the radially-inward surface of the barrel 260 (e.g., the surface of the barrel 260 adjacent to the plunger 280). In such an embodiment, the nickel layer 277 would first be disposed on the radially-inward surface of the barrel 260, and the chrome layer 279 would then be disposed on the nickel layer 279, such that the chrome layer 279 is the outermost layer. In yet another embodiment, when the plunger or the barrel includes a nickel layer and a chrome layer, then the corresponding barrel or plunger may include at least one of a nickel layer and a chrome layer.

Figure 3:
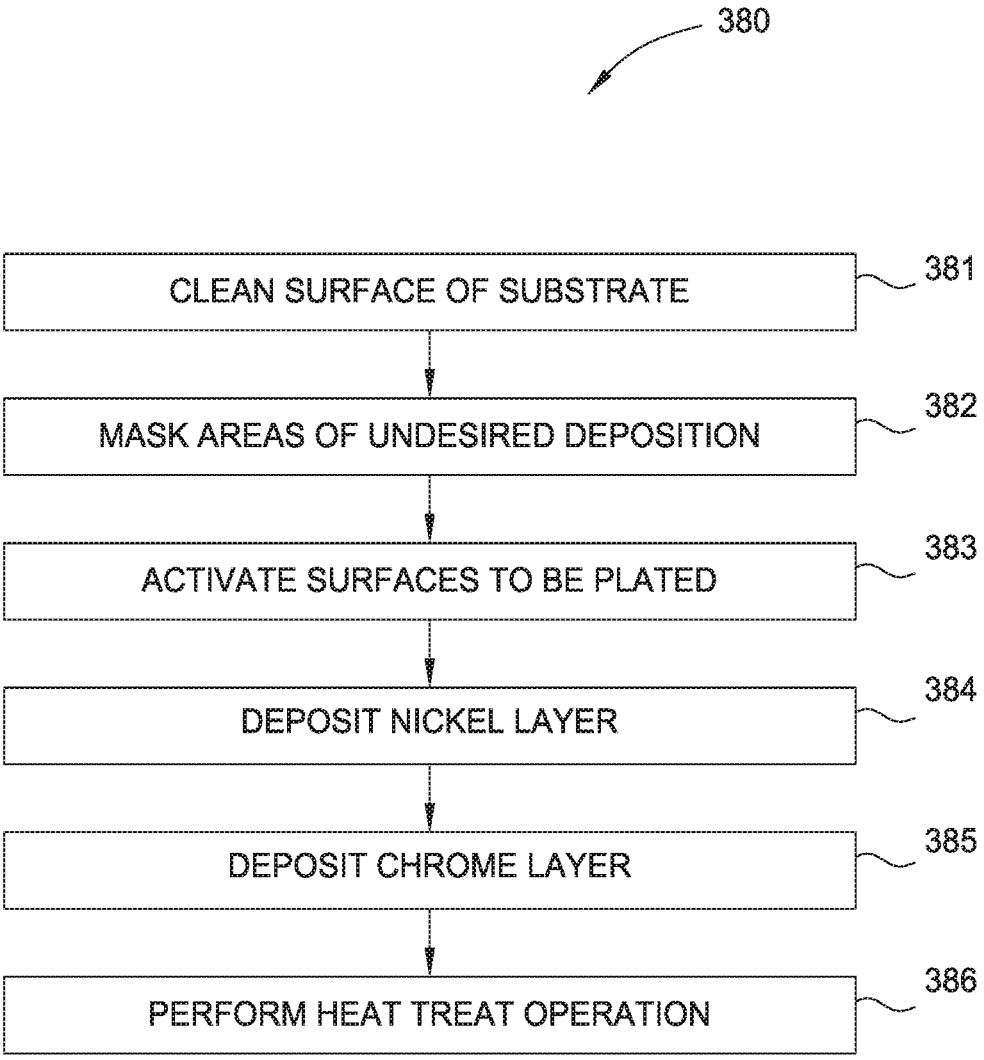
FIG. 3 is a flow diagram of a method for depositing a nickel layer 277 and a chrome layer, according to one embodiment.

FIG. 3 is a flow diagram of a method 380 for depositing the nickel layer 277 and the chrome layer 279 on a substrate. The method 380 begins at operation 381, in which surfaces of a substrate, such as a barrel 260 or a plunger 280, is subjected to a cleaning operation. The operation 381 may include exposure to one or more of a degreasing agent, an alkaline soak, and a clean water rinse to remove particulates or other debris from surfaces of the substrate. In operation 382, optional masking material may be applied to the substrate to mask areas in which deposition of a nickel or chrome is undesired. In operation 383, exposed surfaces of the substrate are activated to facilitate adherence of the nickel layer 277 to the substrate. The activation operation removes films, such as oxide layers, which may interfere with the deposition process. The activation operation may include exposure of the substrate to alkakine compounds, acid compounds, or electrocleaners. Additionally, the activation operation 383 may include a current reversal process. Examples of acidic compounds which may be utilized include hydrochloric acid, hydrofluoric acid, nitric acid, or sulfuric acid.

In operation 384, the nickel layer 277 is deposited on the exposed surfaces of the substrate. The nickel layer 277 may be deposited through an electroless or electroplating process to a thickness of about 5 micrometers to about 80 micrometers, such as about 30 micrometers to about 50 micrometers, for example about 40 micrometers. Subsequently, in operation 385, the chrome layer 279 may be deposited on the nickel layer 277. In one example, the chrome layer 279 may be deposited using an electroless or electroplating process to a thickness of about 40 micrometers or greater, such as about 50 micrometers to about 150 micrometers, for example about 75 micrometers to about 100 micrometers or about 40 micrometers to about 80 micrometers. In operation 386, the nickel layer 277 and the chrome layer 279 are individually or simultaneously subjected to a heat treat process. The heat treat process may include a single exposure or multiple cycles at a temperature of about 190 degrees Celsius to about 232 degrees Celsius. In one example, the heat treat cycle may last about two hours to about four hours. After the heat treat process, the chrome layer 279 may have a hardness of 750 Vickers or more when exposed to either a 50-gram or 100 gram load, and may have a bond strength of 55 megapascals (MPa) or more.

FIG. 3 illustrates one embodiment, however, additional embodiment are also contemplated. In another embodiment, it is contemplated that an undercutting operation may be performed prior to operation 381. In the undercutting operation, material may be removed from the component to be coated so that the dimensions of the coated component remain within desired specifications.

In sum, embodiments herein include rod pumps having increased resistance to scoring while maintain resistance to corrosive fluids.

While embodiments herein describe the use of chrome and nickel layers, it is contemplated that the chrome and nickel layers may also include chrome and nickel alloys. For example, a chromium-based alloy may include one or more of cobalt, tungsten, iron, nickel, or molybdenum. A nickel-based alloy may include, for example, zinc. Metals which may alternatively be used instead of nickel or chrome include brass, zinc, and cobalt.

While the foregoing is directed to embodiments of the present disclosure, other and further embodiments of the disclosure may be devised without departing from the basic scope thereof, and the scope thereof is determined by the claims that follow.

What is claimed is:

1. A rod pump for use in a wellbore, comprising:

a barrel; and a plunger disposed within the barrel, the plunger comprising a nickel layer disposed thereon, and a chrome layer disposed on the nickel layer, wherein the chrome layer forms an outer surface of the plunger.

2. The rod pump of claim 1, wherein the chrome layer has a hardness of 750 Vickers or more when exposed to either a 50-gram or 100 gram load.

3. The rod pump of claim 1, wherein the chrome layer has a bond strength of 55 megapascals (MPa) or more.

4. The rod pump of claim 1, wherein the chrome layer is in contact with the wellbore fluid.

5. The rod pump of claim 1, wherein the nickel layer and the chrome layer have been heat treated.

6. A rod pump for use in a wellbore, comprising:

a barrel; and a plunger disposed within the barrel;

wherein the barrel comprising a nickel layer disposed thereon, and a chrome layer disposed on the nickel layer, and wherein the chrome layer forms an outer surface of the barrel.

7. The rod pump of claim 6, wherein the chrome layer has a hardness of 750 Vickers or more when exposed to either a 50-gram or 100 gram load.

8. The rod pump of claim 6, wherein the chrome layer has a bond strength of 55 megapascals (MPa) or more.

9. The rod pump of claim 6, wherein the plunger comprises a second nickel layer disposed thereon, and a second chrome layer disposed on the second nickel layer.

10. The rod pump of claim 6, wherein the chrome layer is in contact with the wellbore fluid.

11. The rod pump of claim 6, wherein the barrel has undergone an activation operation.

12. A method of processing a rod pump, comprising:

depositing a nickel layer on a barrel or a plunger of the rod pump;

depositing a chrome layer on the nickel layer; and performing an activation operation prior to depositing the nickel layer.

13. The method of claim 12, wherein the nickel layer is deposited by electroplating or by electroless plating.

14. The method of claim 12, wherein the chrome layer is deposited by electroplating or by electroless plating.

15. The method of claim 12, wherein the activation operation includes exposing the plunger or barrel to an alkaline compound or an acidic compound.

16. The method of claim 15, wherein the acidic compound is either hydrochloric acid, hydrofluoric acid, nitric acid, or sulfuric acid.

17. The method of claim 12, further comprising performing a heat treat process on the nickel layer and the chrome layer.

18. The method of claim 17, where the heat treat process comprises heating the nickel layer and the chrome layer to a temperature within a range of about 190 degrees Celsius to about 232 degrees Celsius.

19. The method of claim 17, wherein the chrome layer has a hardness of 750 Vickers or more when exposed to either a 50-gram or 100 gram load.

20. The method of claim 12, wherein the chrome layer has a thickness of about 50 micrometers to about 150 micrometers.

* * * * *